United States Patent [19]

Clauss

[11] Patent Number: 4,657,059

[45] Date of Patent: Apr. 14, 1987

[54] SIDE SUPPORT FOR AN AWNING BOX

[75] Inventor: Ulrich Clauss, Bissingen, Fed. Rep. of Germany

[73] Assignee: Clauss Markisen, Bissingen-Ochsenwang, Fed. Rep. of Germany

[21] Appl. No.: 661,033

[22] Filed: Oct. 15, 1984

[30] Foreign Application Priority Data

Oct. 18, 1983 [DE] Fed. Rep. of Germany ..... 3337740

[51] Int. Cl.[4] ..... E04F 10/06

[52] U.S. Cl. ..... 160/120; 160/22; 160/66; 160/241; 160/323 R

[58] Field of Search ..... 160/120, 22, 25, 29, 160/59, 66, 67, 68, 69, 70, 71, 72, 73, 74, 75, 323 R, 323 B, 324, 325, 326, DIG. 5, 241

[56] References Cited

U.S. PATENT DOCUMENTS

| | | | |
|---|---|---|---|
| 1,472,919 | 11/1923 | Lane | 160/22 |
| 1,790,027 | 1/1931 | Shonnard | 160/120 X |
| 3,285,089 | 11/1966 | Tsugawa | 160/310 X |
| 3,991,805 | 11/1976 | Clauss | 160/22 |
| 4,172,563 | 10/1979 | Werner et al. | 160/310 X |

FOREIGN PATENT DOCUMENTS

| | | | |
|---|---|---|---|
| 2612318 | 10/1976 | Fed. Rep. of Germany | 160/120 |
| 2516577 | 5/1983 | France | 160/67 |
| 7402062 | 8/1975 | Netherlands | 160/120 |
| 7600748 | 7/1977 | Netherlands | 160/22 |
| 1304823 | 1/1973 | United Kingdom | 160/66 |

*Primary Examiner*—Ramon S. Britts
*Assistant Examiner*—David M. Purol
*Attorney, Agent, or Firm*—Collard, Roe & Galgano

[57] ABSTRACT

An awning including an awning box having an outlet slot and, on its end sides, bearings for a winding shaft supported in the box, the awning box being non-rotatably mounted in wall fixtures. The canvas for the awning is connected at one end to the winding shaft and at its other end to the extension bar and is guided through the outlet slot. In order to reduce installation tolerance alignment errors between adjacent awnings, and to simplify the installation, the awning box contains, at least on one side, an attachment extending in the longitudinal direction of the winding shaft. The associated wall fixture, for receiving the attachment, contains at least one bifurcated extension extending at right angles to the longitudinal axis of the winding shaft, so that the attachment is inserted in the jaw of the extension, with the jaw being open in the radial direction with respect to the winding shaft.

28 Claims, 9 Drawing Figures

SIDE SUPPORT FOR AN AWNING BOX

BACKGROUND OF THE INVENTION

The present invention relates to an awning having an awning box with an outlet slot for a canvas and, on the ends thereof, bearings for a winding shaft supported in the box. The canvas is secured at one end by the winding shaft and is guided through the outlet slot of the awning box. The other end of the canvas is secured to an extension bar. The invention also relates to wall fixtures for mounting the awning box on the wall of a building.

An awning of the above type is known from German patent document DE-AS No. 25 14 941, wherein an awning box is accommodated in two approximately C-shaped brackets forming both the wall fixtures for the box and the wall side hinges for the articulated rods of this design.

This known design, though found to be efficient in practical application, is, however, relatively costly in terms of material requirements if no articulated rods are used, as is the case, for example with awnings having an inclined carriage or with vertical awnings. Furthermore, this design can be used only with boxes having sufficient stability against buckling outwardly, because each of the two C-shaped brackets must be fitted with a spacing from the adjacent face side of the box which accommodates the bearings for the winding shaft. Awning boxes with a shell made of plastic material cannot be readily secured in this way.

Furthermore, it was found that when the C-shaped brackets are displaced by directing them toward the center of the awning box, such a displacement, with the given installation tolerances for the brackets, leads to increased deviations in the positioning of the ends of the box from their nominal or proper position. This is particularly true when several awnings are to be driven by one common electric motor, the result being that the awnings' winding shafts have to be mechanically coupled with each other, thereby requiring the installation tolerances to be tightened accordingly, due to the greater displacement of the axes of the winding shafts relative to one another.

SUMMARY OF THE INVENTION

It is, therefore, an object of the present invention to further develop an awning of the type described above in such a way that even awning boxes which are prone to buckling, e.g., awning boxes made of plastic, can be used.

It is a further object of the present invention to allow for the use of a single electric motor to drive a series of awnings without the alignment problems that frequently occur between the side faces of adjacent awning boxes.

For accomplishing these objects, the side face of the awning box, which contains the associated bearing of the winding shaft, is secured in the wall fixture by means of an attachment provided on the side face. Virtually no stress is placed on the shell of the box. The stress which the awning box has to withstand is essentially limited to that of its own weight and the stress generated by the canvas at the outlet slot. These combined forces, however, are relatively small. Furthermore, the end side fastening of the box has the important advantage that adjacent awning boxes, whose winding shafts are to be coupled to one another, are secured with a relatively small spacing between each other. This means that when the wall fixtures are mounted on the facade of a building, the installation tolerances will not result in increased displacement between the axes of the winding shafts.

Finally, the open jaw in the bifurcated extension of the wall fixture permits a simple insertion of the awning box in the wall fixture, which has previously been installed on the wall of the building, by means of a radial motion with respect to the box.

If the attachment extends coaxially to the longitudinal axis of the winding shaft, the awning box remains virtually unchanged in its spatial position when it is turned around the axis of the winding shaft for the purpose of adjusting the position of the outlet slot for the canvas. It is, in this connection, particularly advantageous if the attachment has the shape of a ring or tube in order to save unnecessary material. Furthermore, such a design of the attachment permits the accommodation in the attachment of the bearing for the winding shaft, resulting in a particularly good space-saving structure. The bearing may be a simple grooved ball-bearing in order to keep the force of actuation of the winding shaft low.

In order to prevent the awning box from rotating around its longitudinal axis without an excessive clamping force upon the attachment in the jaw of the bifurcated extension, such rotation being caused by the canvas sliding across the edge of the outlet slot, the cross-section of the attachment has a straight-line polygonal shape, with the width of the cross-section conforming to the width of the mouth.

A very simple arrangement is obtained at favorable manufacturing costs if the attachment has an approximately cup-like shape with the bottom facing the box, and with an inwardly recessed zone in which the bearing is arranged.

A release of the attachment from the jaw of the forked extension of the wall fixture, while the jaw is oriented vertically or horizontally, is prevented if a through-extending bolt is inserted in the forked extension at the open end of the jaw, the bolt closing the mouth at the end side thereof.

If the attachment is designed with a plurality of edges, it is advantageous to arrange the back side of the jaw of the extension with the polygonal cross-section of the attachment. In this way, the torque to be transmitted from the attachment to the extension is distributed over a correspondingly larger number of registering points.

Another possibility comprising shorter forked ends of the wall fixture is to provide the attachment with an approximately annular shape and to associate it with a flange disposed at its end facing away from the box. The flange would be disposed at right angles to the winding shaft and protrude radially beyond the outer circumference of the attachment. In its mounted condition, the flange would be disposed on the side of the forked extension of the wall fixture facing away from the box, and would be anchored or secured on the wall fixture. A very simple structure is obtained if the flange is rigidly connected with the awning box by means of fastening elements, preferably screws, and the attachment is interposed. This would permit the securing of the flange on the box of the awning in several positions of angles of rotation with respect to the winding shaft. For this purpose, the box of the awning is provided, in the simplest case, with a number of openings for the fastening elements. These openings, with respect to the winding shaft, would oppose each other diametrically on the same pitch circle. They would be displaced with respect to each other in pairs by predetermined angles to allow for preselecting the position of the opening slot of the box in accordance with the number of openings selected.

As an alternative, it is possible to provide the flange with a number of openings for the fastening elements. In this case, the openings would oppose each other diametrically on the same pitch circle with the winding shaft, and would be displaced with respect to each other in pairs at predetermined angles.

If the openings so displaced with respect to each other are provided on both the awning box and the flange, a very fine adjustment of the position of the slot is possible if different corresponding angles are selected. By way of example, the angle between the fastening openings of the box may be 30°, whereas the angle on the flange is 15°. This would permit an adjustment of the awning box in stages or steps of 15°, specifically within the range of 0° and 45°, whereby only three pairs of openings are required in each the flange and awning box, without excessively weakening the material of the jacket.

The box of the awning itself is very simple if it is comprised of a substantially cylindrical jacket supporting, at each of its ends, a closing piece and containing a throughextending longitudinal slot for the canvas, with an attachment secured on at least one of the closing pieces. With such a design, any variation in the lengthwise expansion between the material of the jacket of the box and the brickwork of the building can be compensated by mounting, at least, one of the side end closing pieces so that it is displaceable against the cylindrical jacket, but secured against rotation. Each of the closing pieces may have a beaker-like shape and be inserted in the sleeve of the jacket so that it can be displaced lengthwise. Alternatively, the jacket may be inserted in the beaker-like cap in which it is displaceable in the lengthwise direction.

In order to prevent the canvas of the awning from brushing against the walls of the cap and to avoid the necessity of reducing the width of the canvas accordingly, each cap is provided with a slot in its wall that is aligned with the longitudinal slot of the jacket. The slot in the wall of the cap simultaneously serves the purpose of preventing twisting if the longitudinal slot of the jacket is provided with lips which engage with the wall slot in the cap.

The closing piece may also be in the shape of a disk extending at right angles to the winding shaft and displaceably inserted in the jacket. This design is especially advantageous if the jacket is made of transparent material since only a very small part of the closing piece will be visible in the jacket. Furthermore, this design permits a material savings and a simpler manufacture as compared to the beaker-like closing piece described above. In order to lock and prevent the jacket and disk-like closing piece from twisting or rotating with respect to each other, the latter may be provided, on its edge, with at least one radially projecting attachment which, together with the longitudinal slot of the jacket, forms a safety mechanism.

A widening of the opening slot of the jacket can then be effectively prevented, even if the closing piece has the shape of a disk, if the attachments are provided with the shape of a hook, cooperating with two complementary hook-shaped strips on the longitudinal slot of the jacket, in order to keep the edges of the longitudinal slot togther. The cross-section of these strips would then complement the hook-shaped attachments.

Depending on the axial spacing between the end side of the jacket and the extension of the wall fixture, it may be advantageous—in order to obtain a longer or more extensive path of displacement of the jacket—if the disks have a deepened or recessed center zone, and if their edges—which are axially displaced in the direction parallel to the winding shaft—are directed towards the center of the awning box. In such a case, the axial length of the jacket may be dimensioned so that even at high temperatures, it will still fit between the extensions of the two wall fixtures with sufficient clearance. At the same time, the edges of the disks would be disposed farther inside the jacket, so that even with unfavorable tolerances or if the jacket should contract due to lower temperatures, the jacket could not slip off the closing piece.

According to the invention, the material for the awning jacket is advantageously a plastic material, e.g., acrylic glass.

For driving the winding shaft of at least one of the awnings, a drive motor may be inserted in the tubular winding shaft. This drive is secured on the associated wall fixture and the cap is non-rotatably connected with the motor casing.

If several awnings of the same type are to be arranged on the facade of a building in series, the wall fixture contains another drive motor, also with a forked extension extending parallel thereto and with a spacing for receiving the attachments of an adjacent awning of the same type. The mouths in the extensions would be aligned with one another. In this way, no installation tolerances are required at the points of contact between adjacent awnings.

Other objects and features of the present invention will become apparent from the following detailed description considered in connection with the accompanying drawings, which disclose several embodiments of the invention. It is to be understood that the drawings are to be used for the purpose of illustration only, and not as a definition of the limits of the invention.

BRIEF DESCRIPTION OF THE DRAWINGS

In the drawings, wherein similar reference characters denote similar elements throughout the several views.

DETAILED DESCRIPTION OF THE DRAWINGS

Figure 1:
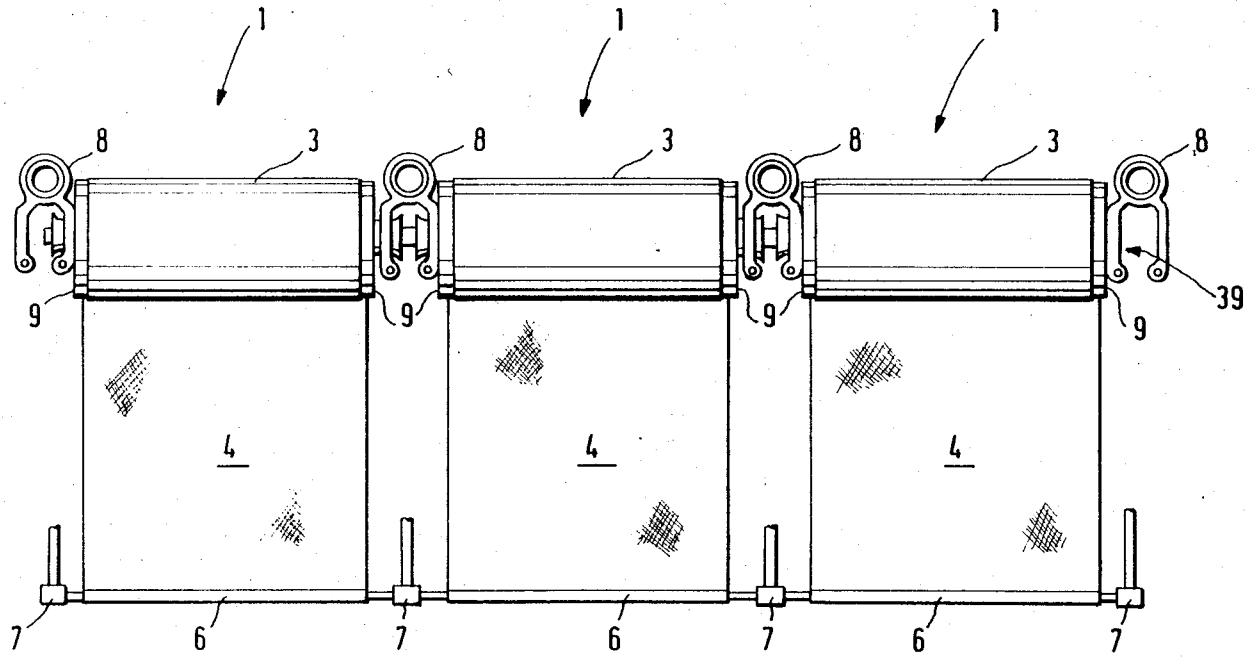
FIG. 1 shows a top view of three awnings according to the invention installed on the facade of a building.

Now, turning to the drawings, in FIG. 1 there is shown three substantially identical awnings 1 installed on the facade or the like of a building (not shown). Each of the awnings 1 contains a winding shaft 2, as clearly seen in the sectional view of FIG. 2. Winding shaft 2 is supported at its ends in an associated awning box 3 and has a canvas 4 fitted around its circumference. Canvas 4 extends outwardly from box 3 by way of a corresponding outlet slot 5. The outer edge of canvas 4 is secured on an extension bar 6. The extension bars 6 of the awnings are aligned with each other and articulated on the drop bars 7. Drop bars 7, which are shown in FIG. 1 broken off, are articulated beneath winding shaft 2 on the facade of the building so that they are rotatable around an axis extending horizontally and parallel to the facade of the building, which is a system with which the person skilled in the art is familiar. When canvas 4 is extended, drop bar 7 folds into an inclined position, starting from a vertical position in which they extend, parallel to the facade of the building. In the inclined position, they support canvas 4, as shown in FIG. 1, in a sloped position away from the facade of the building.

Each of the awning boxes 3 is secured on its face side in an associated wall fixture 8 anchored on the wall of the building, whereby only one wall fixture 8 is provided for two awning boxes 3 at the point of contact between each two adjacent awnings 1. The structure or design of awning boxes 3 and their mounting in wall fixtures 8 are explained in the following in greater detail with reference to FIGS. 2 and 3. According to the left half of FIG. 2, which shows an axial section through the awning 1, awning box 3 is comprised of an approximately cyclindrical jacket 10 made of, e.g., a plastic material such as, e.g., acrylic glass or the like. The jacket is slit lengthwise along the generatrix, forming outlet slot 5. An approximately cup-shaped metal cap 9 is inserted in each of the two face side ends of the longitudinally slotted jacket 10 and displaceable therein in the lengthwise direction. Cap 9 has in its outer wall 11 a slot 12 aligned with the longitudinal slot in the jacket 10 which extends approximately up to the bottom panel 13 of cap 9. The width of slot 12 in cap 9 is dimensioned so that the two lips shaped on jacket 10 within the zone of the longitudinal slot are capable of projecting inwardly through slot 12. These lips extend from the longitudinal slot forming outlet slot 5 and project radially inwardly into jacket 10. Due to the sectional view of FIG. 2, only the lip 14 is visible. In this way, a lock against twisting or rotating is achieved between cap 9 and jacket 10; however, the caps are displaceable lengthwise in jacket 10 either with a tight fit or slight clearance.

Coaxial to the longitudinal axis of winding shaft 2 and box 3, an approximately cup-shaped attachment 15 is secured on the bottom panel 13 of cap 9. Attachment 15 projects axially outwardly and its bottom panel 16 is provided with a recessed zone 17 having a circular cross-section. Zone 17 is disposed coaxially with respect to attachment 15. A grooved ball-bearing 18 supporting winding shaft 2 is seated in the hollow space so formed between bottom panel 13 of cap 9 and bottom panel 16 of attachment 15. Tubular winding shaft 2 contains, at each face side, a non-rotatably secured insert 19 with a square opening 20 extending coaxially with winding shaft 2 and fully through in the axial direction. A square pin 21 is inserted in opening 20. Starting from insert 19, square pin 21 projects axially through a corresponding opening 22 in bottom 13 of cap 9, the bore in the inside bearing ring of the grooved ball-bearing 18 and, by way of a corresponding or matching coaxial opening 23, into and through the bottom panel 16 of attachment 15. The bore in the inside bearing ring of grooved ball-bearing 18 has a diameter approximately conforming to the diagonal of the square cross section of pin 21. In order to prevent an unintentional displacement of pin 21 in insert 19 or grooved ball-bearing 18, insert 19 contains in a correspondingly radial threaded bore and a set screw 24 by means of which pin 21 is clamped in the insert 19.

Attachment 15, which has a polygonal cross-section (normally even-numbered; it is octagonal in the embodiment shown), is seated in the jaw 25 of an associated forked or bifurcated extension 26 of the corresponding wall fixture 8. The width of jaw 25 conforms to the width of the octagonal attachment 15, which, in this way, can be displaced in the mouth 25 in its axial direction, but not rotated therein. Attachment 15 is secured against slipping out of the mouth 25 by a nut and bolt 27. Bolt 27 is inserted by way of two aligned bores 28 provided in the two ends of the fork of extension 26, in this way closing the jaw 25 in front. Since extension 26 extends perpendicularly to the longitudinal axis of winding shaft 2, jaw 25 opens in the radial direction with respect to the winding shaft.

Figure 2:
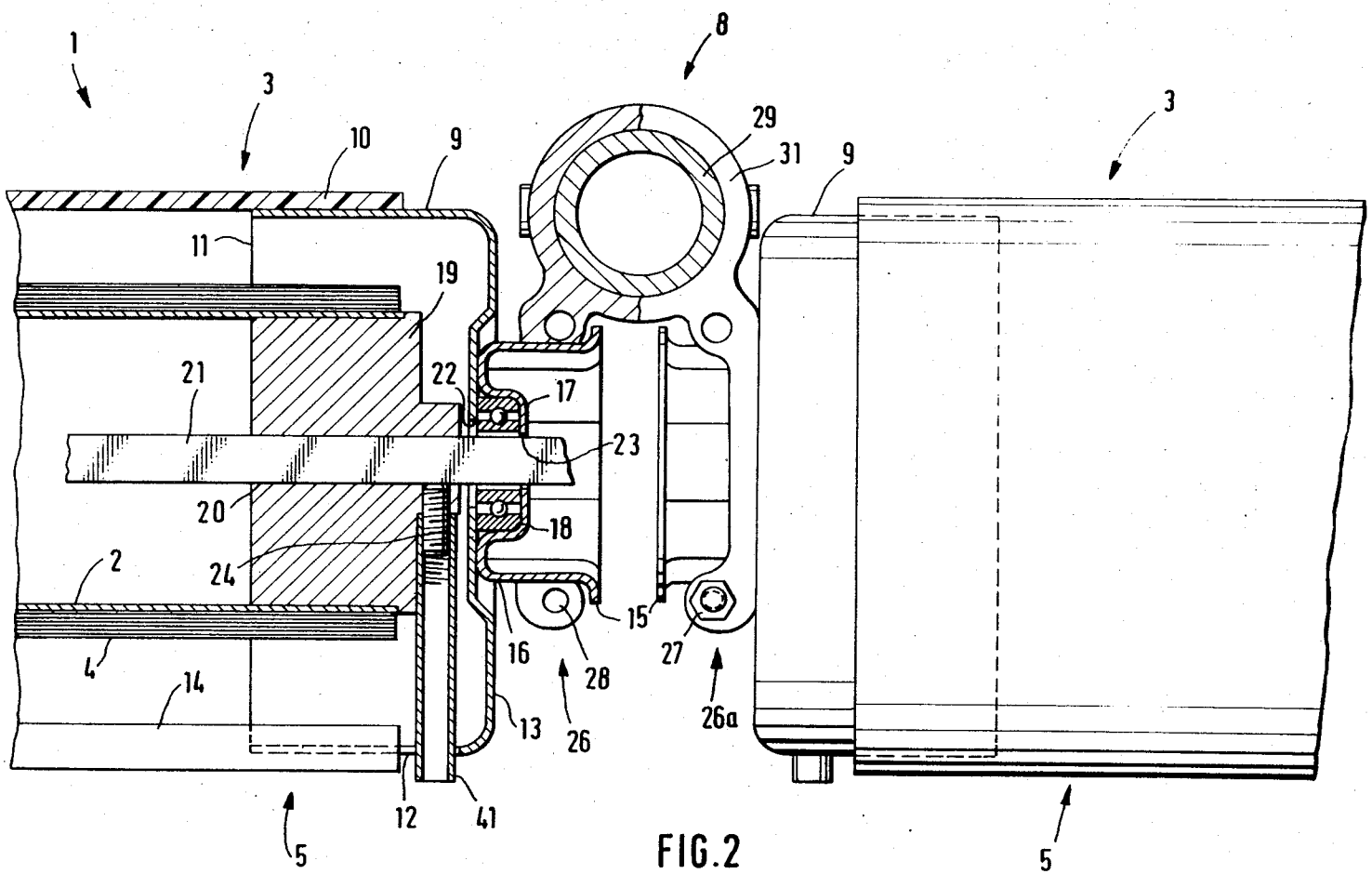
FIG. 2 shows an enlarged top view of the point of contact between two adjacent awnings according to FIG. 1, with the left awning being shown in an axial sectional view.

It is understood that the undiagrammed end of awning 1, shown in the left half of FIG. 2 in a sectional view, is identical with the visible end, and that the other awnings shown in FIG. 1 have the same end design as shown in the left half of FIG. 2.

With the embodiment shown, each of the wall fixtures 8 is secured to a support tube 29 extending substantially vertically with a spacing parallel to the facade of the building, on which it is anchored. For this purpose, wall fixture 8 contains a sleeve 31 which is slidingly received on support tube 29 with a small amount of clearance and clamped with the help of two clamping screws 32 and 33, which are inserted in matching threaded bores and extend radially with respect to support tube 29. Extension 26 is shaped on sleeve 31, forming one piece with the latter. Extension 26 projects radially away from sleeve 31 and tube 29. Jaw 25 of bifurcated extension 26 is open and faces away from sleeve 31 and, therefore, away from the facade of the building, as clearly seen in FIG. 3. A second extension 26*a* is shaped on sleeve 31 parallel to and with a spacing from the first extension 26. The second extension 26*a* is identical with the first extension 26 in terms of shape, so that the two jaws 25 are aligned with each other accordingly. Obviously, wall fixtures 8, instead of being clamped on support tube 29 with sleeve 31, may be anchored to the facade of the building with flanges, in which case extensions 26 and 26*a* are directly formed on the flanges.

Figure 4:
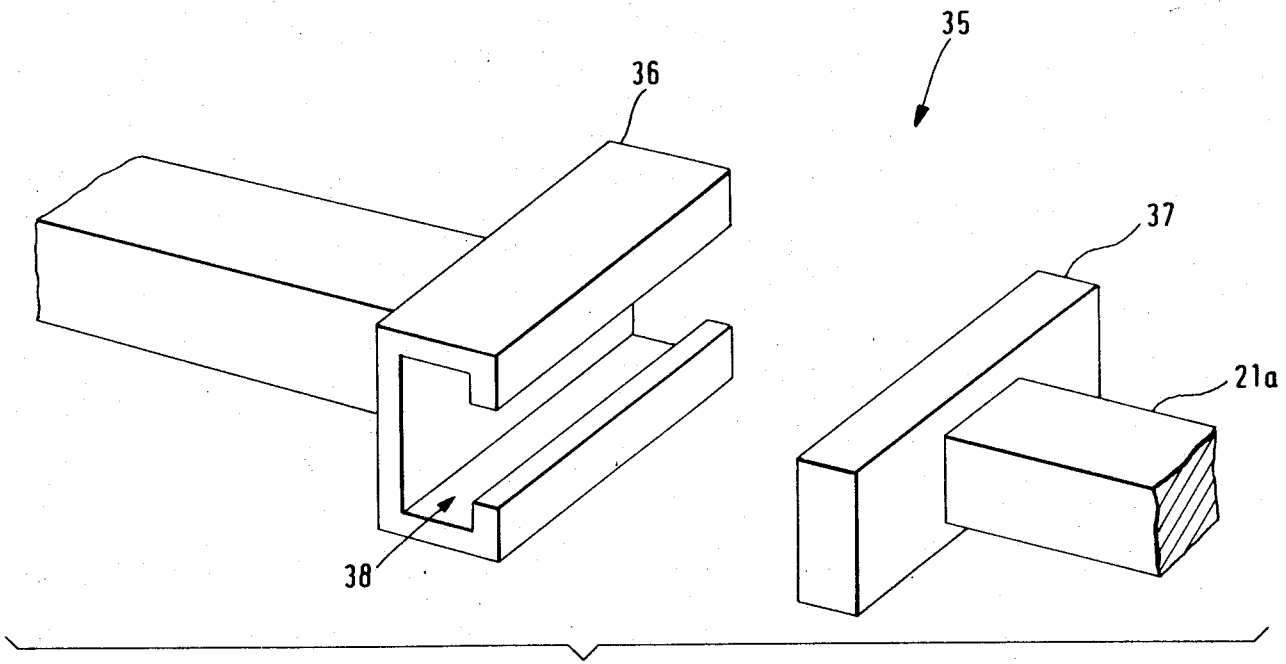
FIG. 4 is a perspective exploded view of the coupling between two adjacent awnings.

Advantageously, the lateral spacing between the two extensions 26 and 26*a* is dimensioned so that a sufficient space is provided between attachments 15 of two adjacent awnings 1 to accommodate a coupling device 35 for coupling the associated winding shafts 2. As clearly seen in FIG. 4, coupling device 35 is comprised of a first and a second coupling member 36 and 37, respectively. By way of example, the first, approximately block-shaped coupling member 36 is secured on the end of the square pin 21 projecting from attachment 15 of a first awning. The second block-shaped coupling member 37 is secured on the end Of the square pin 21*a* of the adjacent second awning. Pin 21*a* is identical with square pin 21 and projects from the associated attachment 15 disposed on the face side; however, the second coupling member 37 is dimensioned so that it fits with sufficient clearance into a corresponding groove 38 of the first coupling member 36, the groove 38 extending at right angles to pin 21. The groove 38 is open both at its end side and in the direction of adjacent pin 21*a*.

Only the awning containing the drive motor for the awning 1 shown in the right hand portion of FIG. 1, deviates from the above description with respect to the design of the face end, in that the drive motor 39 is flanged on the associated bifurcated extension 26 of the corresponding wall fixture 8. The drive motor is designed as specified in application U.S. Ser. No. 651,303, filed Sept. 17, 1984, entitled "Awning With Resilient Motor Coupling". Drive motor 39 projects, with its casing, into tubular winding shaft 2, which is rotatably supported on the casing of the drive motor 39. However, the associated cap 9 of awning box 3 does not have the attachment 15 specified in the foregoing. Rather, cap 9 is seated with its bottom 13 between the extension 26 of wall fixture 8 and the end of drive motor 39 facing the wall support. In all other respects, cap 9 is identical with the one defined earlier.

By jointly mounting two awning boxes 3 in a common wall fixture 8, errors in alignment between adjacent awnings 1 are minimized, so that winding shafts 2 of several awnings 1 can be readily coupled with each other as outlined in the foregoing. The combination of an axially projecting attachment 15 and a forked extension 26 extending at right angles to the attachment readily permits compensating spacing tolerances between the wall fixtures 8 of an awning 1 within the scope of the length of the attachment 15. Finally, the lengthwise displaceable and non-rotatable arrangement of jacket 10 on caps 9 prevents a different coefficient of thermal expansion between the jacket material and the brickwork from causing distortion and buckling of jacket 10, which, if acrylic glass is used, may expand, e.g., by several millimeters as compared to the spacing between two adjacent wall fixtures 8, and displace itself onto cap 9 accordingly.

In order to avoid any twisting of the winding shaft 2 with the bale of awning canvas 4 wound on the shaft during the transit or shipping of the awning, a tube 41 is tightly plugged over the portion of set screw 24 projecting from insert 19, or screwed onto the portion with a matching inside thread. Tube 41 extends outwardly through outlet slot 5, in this way securing winding shaft 2 inside box 3 against rotation. After awning 1 has been installed, tube 41 is removed from set screw 24 and winding shaft 2 is thereby able to freely rotate.

Figure 3:
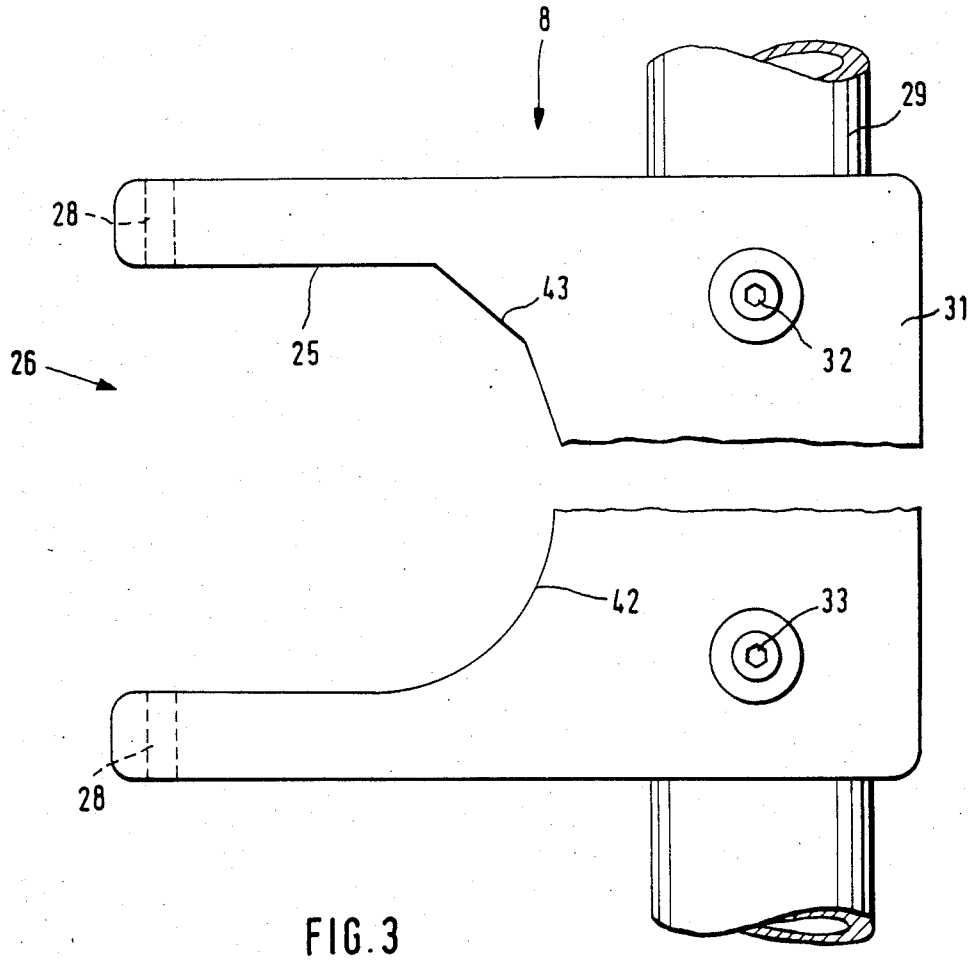
FIG. 3 shows a lateral view of the wall fixture according to FIG. 2.

FIG. 3 shows that the back side 42 of jaw 25 of extension 26 may have an approximately semicircular shape or follow the polygonal peripheral shape of attachment 15. In the latter case, additional points of contact are obtained for the edges of the polygonal attachment and thus a superior distribution of the forces.

Instead of providing for awning box 3 a jacket 10 made of acrylic glass, jacket 10 may be made of sheet metal. In any case, it is selectively possible to plug the cap 9 over the jacket 10 instead of inserting it in jacket 10 as shown in FIG. 2. In the former case, lips 14 serving as a lock against rotation obviously do not project inwardly in the direction of the winding shaft, but rather outwardly, protruding from cap 9 through slot 12.

FIGS. 5 to 8 illustrate another embodiment of awning 1. The components known from the earlier embodiment are identified by the same reference numbers, but not described again in the following.

Figure 5:
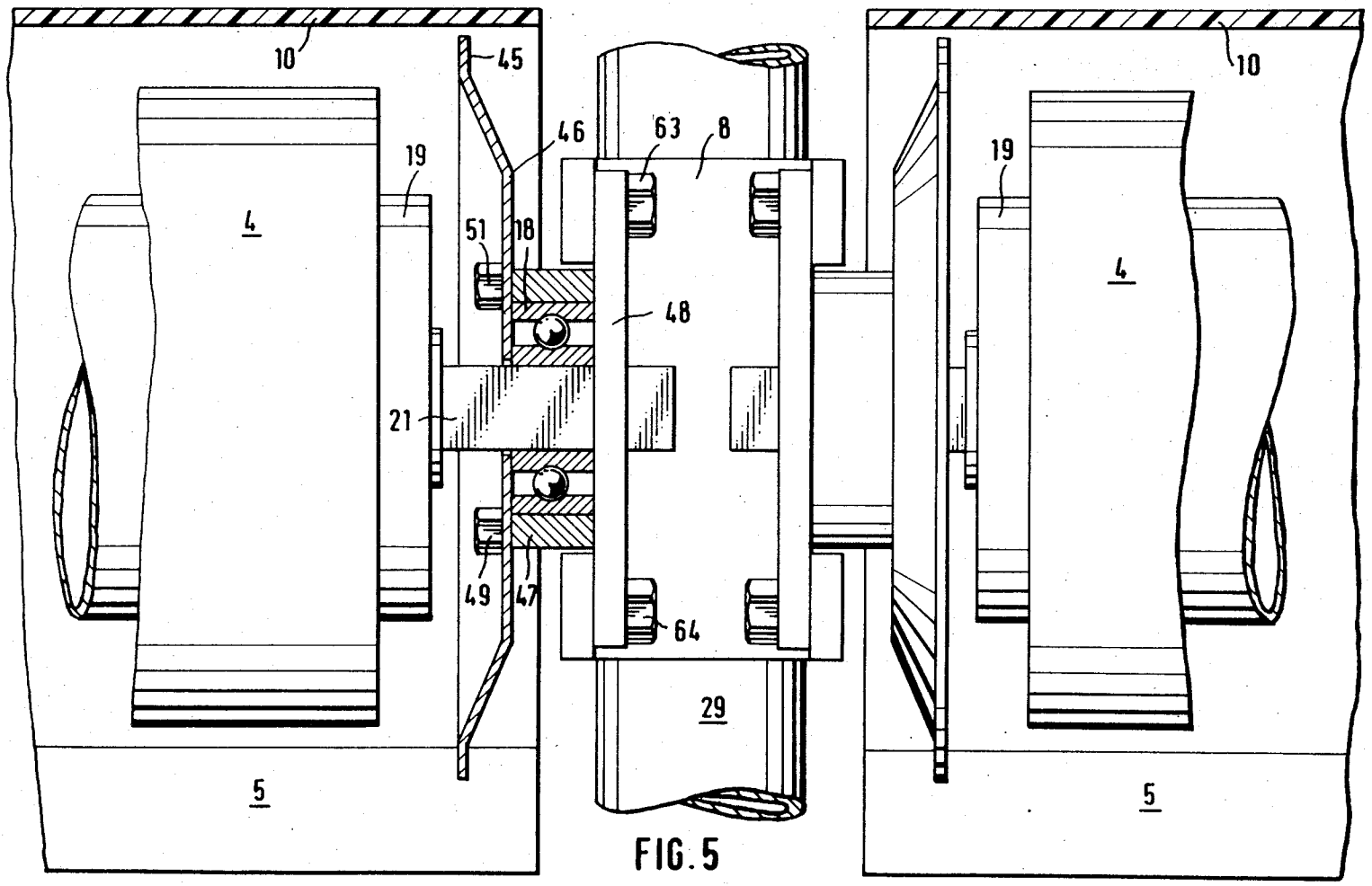
FIG. 5 shows the point of contact between two awnings according to another embodiment of the invention, whereby the left awning is shown in an axial sectional view.

While in the preceding embodiment cap 9 forming the closing piece of the awning box has the shape of a cup, the closing piece of the embodiment according to FIG. 5, serving the purpose of closing the face side end of jacket 10, is a disk 45 matched to the inside shape of jacket 10. The disk may be flat or have a recessed center zone 46 as shown in FIG. 5. In the latter case, the elbow-shaped edge of the disk 45 points in the direction of the center of awning 1. In this way, the elbow-shaped edge of disk 45 engages jacket 10 to a greater depth compared to the flat disk and is therefore capable of compensating for greater length tolerances of jacket 10 without the hazard of jacket 10 slipping off the edge of disk 45.

A ring 47 is secured on the center part 46 of disk 45 coaxially with the substantially circular disk 45 and the driving square 21. The grooved ball-bearing 18 for supporting winding shaft 2 is inserted in the ring. On the side facing away from awning 1, ring 47, which, in terms of its function, corresponds with the cup-shaped attachment 15, is associated with a flange 48 shown by a top view in FIG. 7. The rigid connection between disk 45, ring 47 and flange 48 is achieved by means of two fastening screws 49 and 51 extending through matching openings 52 in disk 45 as well as through a pair of through-extending openings in ring 47 (not shown), which openings are aligned with the openings 52, and into the threaded bores 53 of flange 48. In the simplest case, the flange is a flat square flange provided in the center with a through-extending opening 54 for driving square 21. An opening 55 in disk 45 is, of course, aligned with the opening 54, however, the diameters of the openings 55 and 54 are smaller than the outside diameter of grooved ball-bearing 18, so that the latter is safely secured in ring 47 between disk 45 and flange 48.

Figure 6:
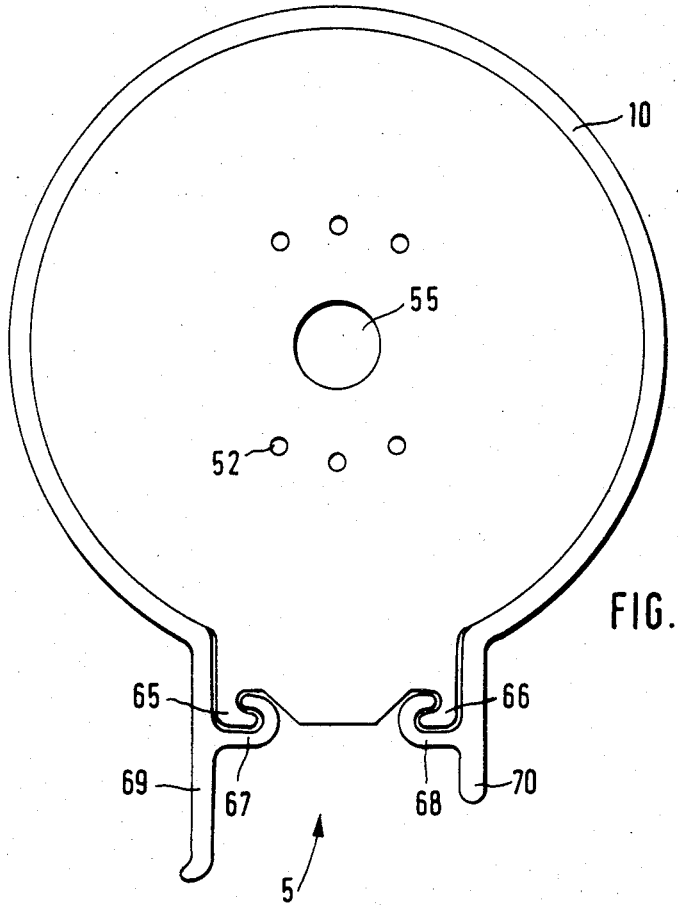
FIG. 6 is a top view of the face side of the awning according to FIG. 5, with the bearing for the shaft removed.

Fastening openings 52 are disposed on a common pitch circle and oppose each other diametrically in pairs with respect to the axis of winding shaft 2, or the center of opening 55, as clearly seen in FIG. 6, in which three pairs of fastening openings 52 are illustrated. In each case, the pairs of fastening openings 52 are displaced against each other on the plane of disk 45 by an angle of 30° with respect to the axis of winding shaft 2.

Threaded bores 53 of flange 48 are also displaced on the same divided circle as openings 52 and oppose the latter diametrically in pairs with respect to the center of opening 54. However, the three pairs of threaded bores 53, shown in FIG. 7, are displaced against each other by 15°, so that in combination with the fastening openings 52, several associations are possible between flange 48 and disk 45 turned in steps of 15°.

Figure 7:
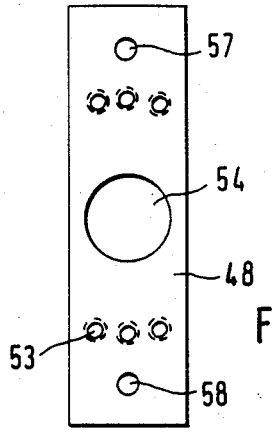
FIG. 7 is a top view of the flange of the awning according to FIG. 5, for securing the awning on the wall fixture.
Figure 8:
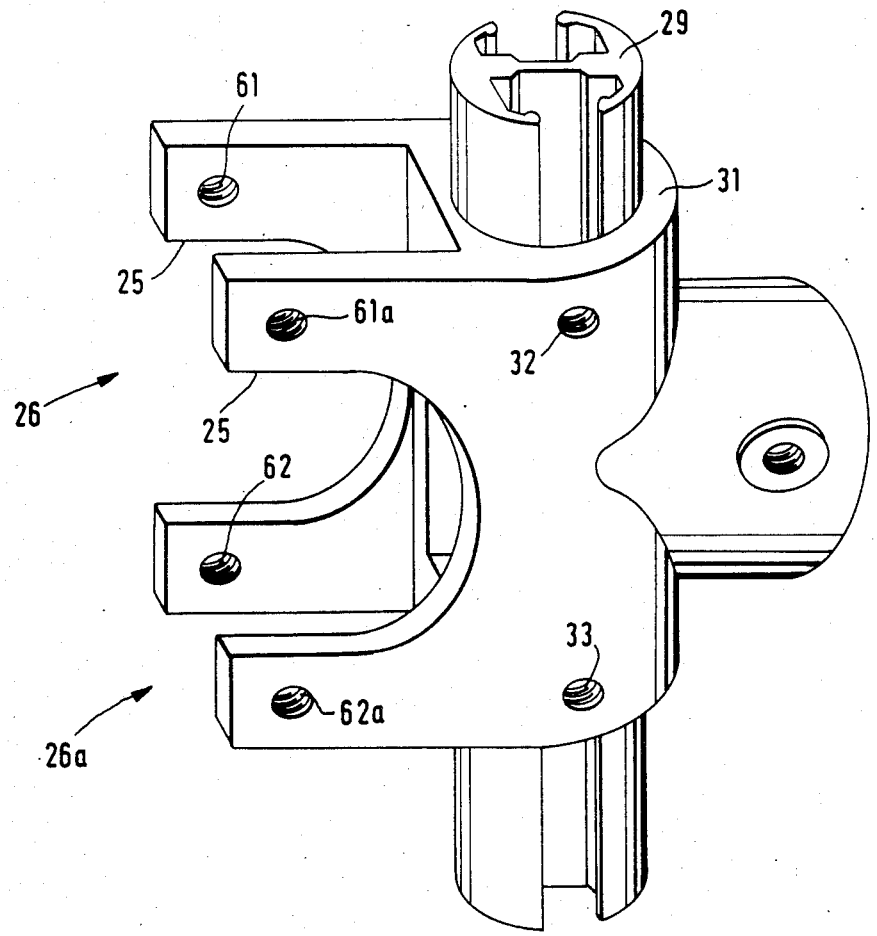
FIG. 8 is a perspective view of the wall fixture of the awning according to FIG. 5.

While with the preceding embodiments the non-rotatable connection between cup-shaped attachment 15 and jaw 25 of bifurcated extension 26 is obtained by the polygonal outer shape of attachment 15, the embodiment according to FIG. 7 shows that the flange 48, which is rigidly screwed with disk 45, is threadably combined with extension 26. For this purpose, flange 48 contains two bores 57 and 58, which oppose each other diametrically with respect to opening 54 and which are aligned with the corresponding threaded bores 61 and 62 provided in the legs of forked extension 26. In the installed condition, threaded bores 61 and 62 accommodate fastening screws 63 and 64, which extend through bores 57 and 58 and which rigidly connect flange 48 with wall fixture 8. In the installed state, forked extension 26 is disposed between flange 48, which extends perpendicularly to the longitudinal axis of winding shaft 2, and associated disk 45, with which extension 26 is threadably rigidly connected together with ring 47 interposed between the two elements. The back side of jaw 25 is adapted to the shape of ring 47.

In this way, the installation is highly simplified in that no assistance is required to fit the parts since the outside diameter of ring 47 is equal to the inside width between the legs of forked extension 26. Awning 1, which is preassembled by the manufacturer, needs to be pushed only with ring 47 into the mouths 25 of wall fixtures 8 already installed on the wall of the building. This provides the awning with preliminary support and therefore, no personnel are required to hold it. Now, the two fastening screws 63 and 64 can be readily inserted in bores 57 and 58 of flange 48 and tightened in the threaded bores 61 and 62 of extension 26. Any differences in the spacing between adjacent wall fixtures 8 can be readily compensated for because disk 45 can be displaced lengthwise in jacket 10, on the one hand, and driving square 21 can be displaced lengthwise in grooved ball-bearing 18 or end piece 19 of winding shaft 2 on the other.

The driving coupling between adjacent awnings is achieved as explained for the preceding embodiment. Obviously, the adjacent awning is secured in the same way, which means that in this case as well, wall fixtures 8 contain two forked extensions 26 and **26*a* shaped on the jacket or sleeve 31; the extensions also being provided with fastening bores 61*a* and 62*a***.

In order to prevent jacket 10 from twisting or rotating on disks 45, the jacket is provided on its edge with at least one radially projecting attachment protruding into outlet slot 5. In the embodiment shown, two attachments, 65 and 66, are provided with a hook-like shape, with all ends of the hooks pointing toward each other. The hook-like attachments 65 and 66 are engaged in a form-locked manner by two hook-shaped strips 67 and 68 each having a cross-section of a complementary shape. The strips are shaped on jacket 10 within the zone of outlet slot 5 and extend across the total length of jacket 10 parallel to the longitudinal axis of winding shaft 2.

In this embodiment, hook-shaped strips 67 and 68 are seated on approximately radially projecting lips 69 and 70 defining outlet slot 5. These lips are shaped on the jacket 10 within the zone of outlet slot 5, forming one piece with the jacket. When canvas 4 of the awning is extended, extension bar 6 is capable of resting tightly on the lips.

A form-closed lock is achieved between jacket 10 and disk 45 by the way in which the hook-shaped strips 67 and 68 on the opposing side are oriented. This lock prevents jacket 10 from turning on disk 45 and, furthermore, prevents any widening of jacket 10 along outlet slot 5, at least within the zone of disk 45.

By aligning the fastening openings 52 on disk 45 with the hook-shaped attachment 65 and 66 accordingly, it is possible to have the outlet slot for the canvas turned sideways, e.g., starting from a first position or adjustment, in which the outlet slot is pointing vertically downward, the positioning of the outlet slot may be varied in steps of 15° up to an angle of 45°, in either direction, as compared to the vertical.

If disk 45, as shown in the drawings, is used with awning box 3 for closing jacket 10 at its ends, then the drive motor disposed in winding shaft 2 is preferably not flanged directly on extension 26 of wall fixture 8, as with the design described in the foregoing, but rather installed so that its fastening flange rests against the inward side of disk 45. In this embodiment, disk 45, ring 47 and flange 48 are assembled by threadable engagement. Here, the advantage is that the installation procedure is the same irrespective of whether an awning 1 with a drive motor 39 is installed or a series of awnings are mounted which are coupled with only a single drive motor.

Figure 9:
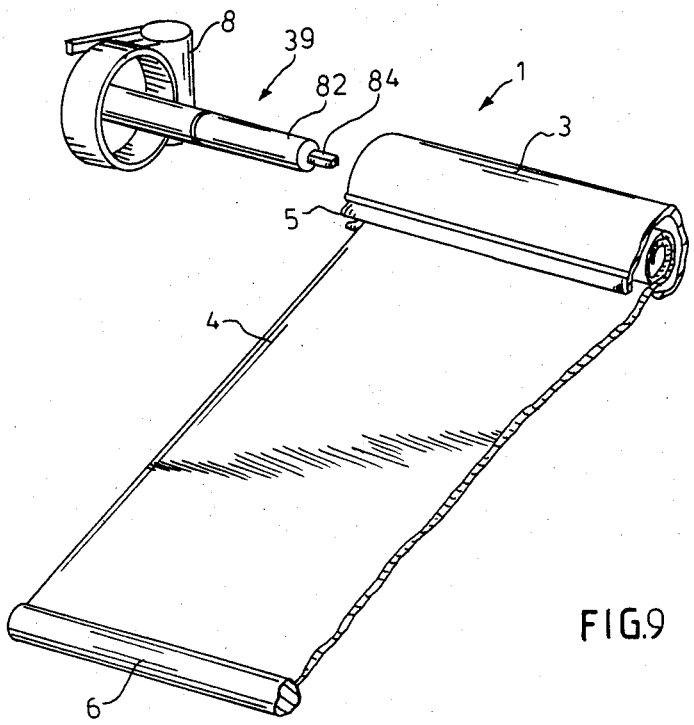
FIG. 9 is an exploded perspective view of a portion of an awning showing the wind-up motor therefor.

In FIG. 9 there is shown a drive motor 39 for operating awning 1. Drive motor 39 in the mounted condition is accommodated in the winding shaft (not shown) of the embodiment of FIG. 1 or the embodiment of FIG. 2. The cylindrical casing 82 of drive motor 39 is provided with a slender shape in order to fit within the winding shaft and is provided with an output shaft 84 projecting from casing 82 and which is coupled with the winding shaft so as to impart rotational movement thereto from motor 39. The end of motor 39 at the face side of the awning is fixedly attached to wall fixture 8 so as to be non-rotatable with respect thereto.

While only a few embodiments of the present invention have been shown or described, it will be obvious that many changes and modifications may be made thereunto without departing from the spirit and scope of the present invention.

What is claimed is:

1. An awning comprising:

(a) an awning box having side faces, said awning box including a substantially cylindrically shaped jacket having a longitudinal slot therein forming an outlet slot, an end closing piece supported at each side face, and a winding shaft;

(b) bearings at the ends of said awning box for said winding shaft;

(c) an awning canvas having first and second ends, said first end being connected to said winding shaft and said second end being connected to an extension bar, said awning canvas being guided through said outlet slot of said awning box;

(d) wall fixtures for non-rotatably mounting said awning box at its side faces on the facage of a building, each of said wall fixtures having at least one bifurcated jaw like extension extending perpendicularly to a longitudinal axis of said winding shaft, said jaw like extension being open in the radial direction with respect to said winding shaft; and (e) an attachment secured on at least one of said end closing pieces at a side face of said awning box extending in the longitudinal direction of said winding shaft and received in said jaw like extension of an associated wall fixture, means for permitting at least one of said closing pieces to be longitudinally displaceable relative to said cylindrically shaped jacket and to be secured against rotation relative thereto so as to permit longitudinal movement of said cylindrically shaped jacket relative to said at least one end closing piece.

2. The awning as defined in claim 1, wherein said attachment is tubular shaped and extends coaxially with the longitudinal axis of said winding shaft.

3. The awning as defined in claim 1, wherein the bearing for said winding shaft is disposed in said attachment.

4. The awning as defined in claim 3, wherein said bearing is a grooved ball bearing.

5. The awning as defined in claim 1, wherein the cross-section of said attachment has an even-numbered sides polygonal shape and a width corresponding to the width of the jaw of said bifurcated extension.

6. The awning as defined in claim 3, wherein said attachment has an approximately cup-like shape with a bottom panel facing said awning box having an inwardly recessed zone in which said bearing is disposed.

7. The awning as defined in claim 1, wherein a through-extending bolt is inserted at the open end of said jaw in said bifurcated extension, said bolt securing said attachment disposed in said jaw from slipping therefrom.

8. The awning as defined in claim 5, wherein the back side of said jaw of said bifurcated extension complements the polygonal cross section of said attachment.

9. The awning as defined in claim 1, wherein said attachment is approximately annularly shaped and at its end facing away from said awning box is associated with a flange extending perpendicularly to said winding shaft and projecting beyond the outer periphery of said annular attachment, said flange being disposed on the side of said bifurcated extension of the wall fixture facing away from the awning box and rigidly secured by means of fastening elements on the surface of said bifurcated extension of the wall fixture adjacent to said flange.

10. The awning as defined in claim 9, wherein said fastening elements comprise screws.

11. The awning as defined in claim 9, wherein said flange is connected with said awning box by means of fastening elements, with the attachment interposed between said flange and said awning box.

12. The awning as defined in claim 11, wherein said fastening elements comprise screws.

13. The awning as defined in claim 9, wherein said flange is capable of being secured on said awning box in a plurality of positions of angles of rotation relative to said winding shaft.

14. The awning as defined in claim 12, wherein said awning box has a plurality of openings for said fastening elements, said openings opposing each other diametrically in the same pitch circle with respect to said winding shaft and being displaced with respect to each other in pairs of predetermined angles.

15. The awning as defined in claim 14, wherein said flange has a plurality of openings for said fastening elements, said openings opposing each other diametrically on the same pitch circle with respect to said winding shaft and being displaced with respect to each other in pairs by predetermined angles.

16. The awning as defined in claim 15, wherein the angles by which the openings in said flange are displaced with respect to each other are less than the angles by which the openings in the awning box are displaced with respect to each other.

17. The awning as defined in claim 16, wherein the openings in said flange are displaced with respect to each other by half as much as the angles by which the openings in the awning box are displaced.

18. The awning as defined in claim 1, wherein both closing pieces of said awning box have a cup-like shape and are connected displaceably lengthwise with said jacket, whereby the wall forming the shape of the cup faces the center of said awning box and each of the cup-shaped closing pieces has in its wall a slot aligned with the longitudinal slot of said jacket.

19. The awning as defined in claim 18, wherein radially projecting lips are formed on the longitudinal slot of said jacket, said lips extending radially through the slot provided in the wall of said closing piece and forming therewith a lock against rotation.

20. The awning as defined in claim 19, wherein said lips extend radially inwardly.

21. The awning as defined in claim 19, wherein said lips extend radially outwardly.

22. The awning as defined in claim 1, wherein said closing pieces disposed at both sides of said awning box have the shape of disks extending perpendicularly to said winding shaft inserted in said jacket both displaceably and secured against rotation.

23. The awning as defined in claim 22, wherein said disks support on their edge at least one radially projecting attachment forming jointly with the longitudinal slot of said jacket a lock securing said jacket against rotation.

24. The awning as defined in claim 23, wherein said attachments have a hook-like shape and cooperate with two sectionally complementary hook-shaped strips formed on the longitudinal slot of said jacket to secure said jacket by a form-closed lock against rotation.

25. The awning as defined in claim 22, characterized by the fact that said disks have a recessed center zone and their edges are displaceable axially in the direction parallel to said winding shaft, said disks pointing in the direction of the center of said awning box.

26. The awning as defined in claim 1, wherein said jacket is made of plastic material.

27. The awning as defined in claim 17, which further includes a drive motor installed in the winding shaft and anchored therein on the associated wall fixture, whereby the closing piece is non-rotatably connected with the casing of said motor.

28. The awning as defined in claim 1, which further includes a second bifurcated extension on said wall fixture spaced from and aligned with said first bifurcated extension for receiving the attachment of an adjacent awning whereby the winding shafts of said adjacent awnings are substantially aligned.

* * * * *